United States Patent [19]

Tate

[11] Patent Number: 4,913,286

[45] Date of Patent: Apr. 3, 1990

[54] SOCKET TERMINAL CARRIER ASSEMBLY

[76] Inventor: John O. Tate, Carney St., Uxbridge, Mass. 01569

[21] Appl. No.: 371,701

[22] Filed: Jun. 23, 1989

Related U.S. Application Data

[63] Continuation-in-part of Ser. No. 298,483, Jan. 18, 1989, abandoned.

[51] Int. Cl.[4] ..... B65D 73/02

[52] U.S. Cl. ..... 206/329; 206/562

[58] Field of Search ..... 206/328, 329, 560, 562

[56] References Cited

U.S. PATENT DOCUMENTS

| | | | |
|---|---|---|---|
| 3,545,606 | 12/1970 | Bennett et al. | 206/329 |
| 4,422,708 | 12/1983 | Birnholz | 206/329 |
| 4,442,938 | 4/1984 | Murphy | 206/329 |
| 4,586,607 | 5/1986 | Dubbs et al. | 206/329 |
| 4,615,927 | 10/1986 | Holzmann | 206/329 |
| 4,787,510 | 11/1988 | Powell | 206/329 |

*Primary Examiner*—Joseph Man-Fu Moy

*Attorney, Agent, or Firm*—Salter & Michaelson

[57] ABSTRACT

A socket terminal carrier assembly includes a substantially rigid carrier board having a plurality of apertures therein, a plurality of carrier pins secured in the apertures and a plurality of socket terminals releasably received on the carrier pins so that they project outwardly in a predetermined array from one side of the carrier board. The socket terminal carrier assembly is operable for assembling the socket terminals thereof with a circuit board by positioning the assembly so that the pin portions of the socket terminals are received in apertures in the circuit board and then soldering the pin portions of the socket terminals in the apertures.

11 Claims, 2 Drawing Sheets

SOCKET TERMINAL CARRIER ASSEMBLY

BACKGROUND AND SUMMARY OF THE INVENTION

This application is a continuation-in-part of Application No. 07/298,483, filed Jan. 18, 1989.

The instant invention relates to electrical circuit boards and more particularly to a socket terminal carrier assembly for assembling a plurality of socket terminals on a circuit board in a predetermined array.

Heretofore, socket terminals have been widely used in circuit boards, including printed circuit boards, for receiving and electrically connecting the terminal pins of various electrical components with various other circuit components. In this regard, while in some instances relatively simple circuit boards have generally only included small quantities of socket terminals, more complex circuit boards have often included large quantities of socket terminals which are disposed in closely spaced relation in predetermined grid arrays. In any case, in most instances socket terminals have generally been assembled with circuit boards so that the pin portions of the socket terminals are soldered in preformed apertures in the circuit boards. However, it has been found that it is generally essential for electrical socket terminals to be precisely assembled in proper orientations on circuit boards in order to enable them to effectively receive the electrical terminal pins of other circuits or circuit components. It has also been found that it is important for socket terminals to be assembled on circuit boards without being scratched or damaged during assembly procedures so that they can be reliably utilized for effecting electrical connections with other circuit components or circuit assemblies.

Heretofore, it has generally been known to utilize aluminum carrier boards having predetermined arrays of downwardly extending aluminum sheet metal fingers thereon for assembling socket terminals on circuit boards in predetermined arrays. Aluminum carrier boards of this type have been utilized by first assembling socket terminals on the aluminum fingers thereof and then assembling the socket terminals with the desired circuit boards. Thereafter, the socket terminals are soldered to the circuit boards and then disengaged from their associated aluminum fingers. However, it has been found that it is generally not possible to effectively and economically construct aluminum carrier boards which can be utilized for simultaneously assembling large numbers of socket terminals in relatively complex arrays on circuit boards. Further, since the heretofore available aluminum carrier assemblies have generally been made from sheet aluminum, the fingers thereof have generally been positioned adjacent the peripheral edges of their respective boards. Still further, the sheet metal aluminum fingers thereof have generally not been of cylindrical configuration and hence, they have often tended to cause damage to the internal surfaces of socket terminals.

Another type of heretofore available carrier assembly for assembling socket terminals on printed circuit boards is disclosed in the U.S. Pat. No. 4,442,938, to MURPHY. The carrier assembly disclosed in this patent comprises a flexible plastic sheet having a plurality of apertures therein which are disposed in a predetermined array and a plurality of socket terminals which are releasably snap received in the apertures in the flexible sheet. It has generally been found that carrier assemblies of this type are relatively expensive to manufacture although in some instances they can be effectively utilized for assembling socket terminals with printed circuit boards. However, because the socket terminals of carrier assemblies of this type are held by flexible plastic sheets, they are not always precisely maintained in parallel relation during assembly operations. Accordingly, carrier assemblies of this type have often been found to be less than entirely satisfactory for assembling socket terminals in predetermined arrays on circuit boards in applications wherein the socket terminals must be assembled in precisely parallel relation with each other and in precisely perpendicular relation with circuit boards. For similar reasons, it has also been found that they generally cannot be utilized in automated assembly operations.

Still another type of heretofore available socket terminal carrier assembly comprises a carrier board having a plurality of apertures therethrough which are disposed in a predetermined array and a plurality of carrier pins which are received and secured in the apertures so that the terminal end portions of the carrier pins project outwardly in substantially parallel relation from one side of the carrier board. This type of socket terminal carrier assembly further comprises a plurality of socket terminals which are releasably received and frictionally retained on the terminal end portions of the carrier pins thereof so that the socket terminals are disposed in the same predetermined array and maintained in parallel relation with each other. The carrier board of this assembly generally comprises a substantially rigid molded plastic wafer board of the type commonly utilized in conventional pin grid array socket assemblies and the carrier pins are made of a suitable metal. Further, the terminal end portions of the carrier pins are of slightly tapered configuration and of substantially circular cross section so that they can be utilized for releasably receiving and retaining socket terminals thereon. The carrier board element is substantially flat and in some cases, the socket terminal carrier assembly includes a plurality of standoff pins which are integrally formed with the carrier board and project outwardly by a predetermined distance from one side thereof. In this case, the standoff pins are operative for positioning the carrier board in a predetermined spaced relation to a circuit board during an assembly operation so that the socket terminals can be maintained in the desired positions to produce proper solder fillets on the top and bottom surfaces of the circuit board during a solder operation.

The instant invention provides an improved socket terminal carrier assembly of the above described general type comprising a carrier board, a plurality of carrier pins which are received and secured in apertures in the carrier board and a plurality of socket terminals which are releasably received on the carrier pins so that they can be effectively assembled in a predetermined orientation on a printed circuit board. However, the carrier pins of the socket terminal carrier assembly of the instant invention are adapted to enable socket terminals to be more easily released therefrom. Specifically, the terminal portions of the carrier pins include substantially spherical terminal end elements which are adapted to be snap received in socket terminals of a type having angularly inwardly extending resilient fingers therein so that the resilient fingers and the substantially spherical terminal end elements cooperate to releasably retain the socket terminal elements on the carrier pins.

In particular, the terminal end elements and the resilient fingers cooperate to retain the socket terminals on the carrier pins so that they can nevertheless be readily and easily removed or disengaged therefrom when desired.

It has been found that the socket terminal carrier assembly of the instant invention can be effectively utilized for assembling a plurality of socket terminals in precise orientations in apertures in a circuit board. Specifically, it has been found that because the socket terminals of the socket terminal carrier assembly are firmly, yet releasably retained on the carrier pins by means of the terminal end elements, the socket terminals are effectively maintained in parallel relation to each other throughout an assembly operation so that they can be either manually or automatically assembled with a circuit board. Further, the socket terminals can be precisely maintained in desired orientations while they are soldered to a circuit board and they can be readily and easily disengaged from the carrier pins after the socket terminals have been assembled on a printed circuit board.

Accordingly, it is a primary object of the instant invention to provide an improved socket terminal carrier assembly for assembling a plurality of socket terminals on a circuit board in a predetermined array.

Another object of the instant invention is to provide an effective socket terminal carrier assembly which is operative for maintaining a plurality of socket terminals in substantially parallel relation while they are assembled on a circuit board.

An even further object of the instant invention is to provide an effective socket terminal carrier assembly comprising a plurality of carrier pins which are readily and easily releasable from socket terminals received thereon.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
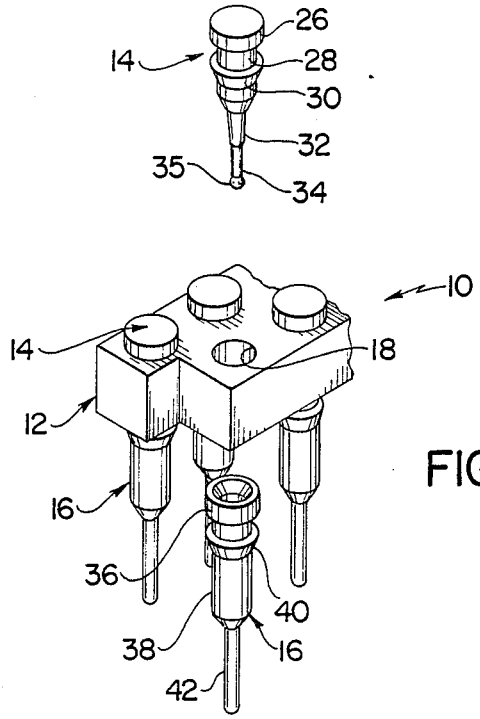
FIG. 1 is a fragmentary exploded perspective view of the socket terminal carrier assembly of the instant invention.
Figure 3:
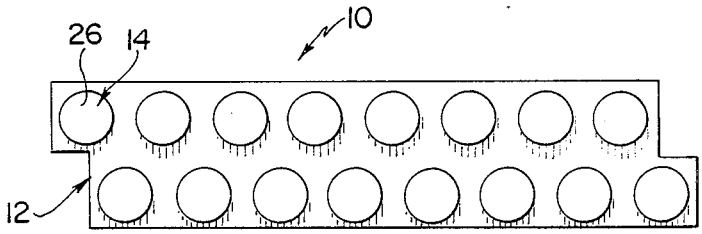
FIG. 3 is a top plan view thereof.
Figure 2:
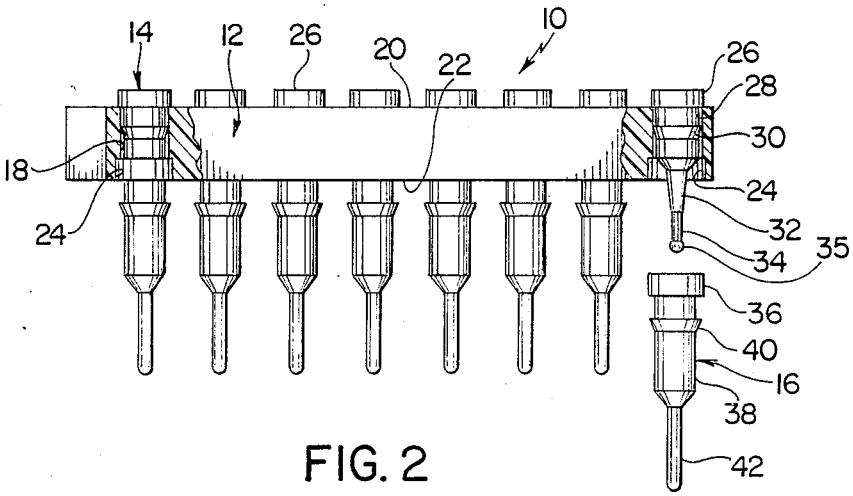
FIG. 2 is a side elevational view thereof with one of the socket terminals removed.

Referring now to the drawings, a first embodiment of the socket terminal carrier assembly of the instant invention is illustrated and generally indicated at 10 in FIGS. 1 through 3. The socket terminal carrier assembly 10 comprises a carrier board generally indicated at 12, a plurality of carrier pins 14 which are received in apertures in the carrier board 12, and a plurality of socket terminals 16 which are releasably received on the carrier pins 14. The socket terminal carrier assembly 10 is operative for precisely maintaining the socket terminals 16 in predetermined orientations while they are assembled on an electrical circuit board, such as a printed circuit board. Further, once the socket terminals 16 have been permanently secured to a circuit board, they can be disengaged from the carrier pins 14 to permit the carrier board 12 and the carrier pins 14 to be removed from the circuit board.

The carrier board 12 preferably comprises a conventional wafer board of the type commonly utilized in pin grid array sockets. Accordingly, the carrier board 12 is preferably integrally molded from suitable substantially rigid plastic material, and it has a plurality of apertures 18 therein which are dimensioned for receiving socket terminals, such as the socket terminals 16, therein, so that the socket terminals 16 are maintained in substantially perpendicular relation to the board 12 and in a predetermined array. The carrier board 12 has a first side 20 and a second side 22 and the apertures 18 include enlarged portions 24 which are disposed adjacent the second side 22.

The carrier pins 14 are preferably of circular cross section and made of a suitable metal such as brass and they include enlarged heads 26, reduced main body portions 28 having annular barbs 30 thereon, tapered intermediate end portions 32, and reduced, cylindrical terminal end portions 34 which terminate in enlarged, preferably substantially spherical, terminal end elements 35. The carrier pins 14 are assembled in the apertures 18 in the carrier board 12 so that the barbs 30 engage the walls of the apertures 18 to permanently secure the carrier pins 14 in the apertures 18. Further, the carrier pins 14 are assembled in the apertures 18 so that the enlarged head portions 26 engage the first side 20 of the carrier board 12 and so that the intermediate and terminal end portions 32 and 34, respectively, thereof project downwardly from the second side 22 of the carrier board 12.

The socket terminals 16 are of conventional construction, and they are preferably made of a suitable conductive metal, although they may also be plated with gold or other precious metals to adapt them for specific applications. The socket terminals 16 include enlarged upper socket portions 36, reduced cylindrical main body portions 38 having enlarged annular barbs 40 thereon, and elongated terminal pin portions 42. The socket terminals 16 have sockets 43 formed therein and they further include resilient angularly, inwardly extending contact fingers 43 which are adapted to engage electrical terminal pins in order to electrically connect the socket terminals 16 to the terminal pins. The socket terminals 16 are assembled on the terminal end portions 34 of the carrier pins 14 so that the ends of the internal contact fingers **43*a* of the socket terminals 16 engage the terminal end elements 35 to retain the socket terminals 16 on the carrier pins 14. However, since the terminal end elements 35 of the carrier pins 14 are substantially spherical, the resilient fingers 43*a* can pass over the terminal end elements 35 to permit the carrier pins 14 to be disengaged from the socket terminals 16 after the socket terminals 16 have been secured on a circuit board. In any event, when the socket terminals 16 are assembled with the carrier pins 14, the enlarged upper socket portions 36 are received in the enlarged portions 24 of the apertures 18 so that the socket terminals 16 are firmly retained in parallel relation on the board 12 and project outwardly from the second side 22** thereof.

For use of the socket terminal carrier assembly 10, the pin portions 42 of the socket terminals 16 are assembled in apertures in a circuit board, and thereafter the pin portions 42 are soldered to the circuit board by conventional soldering techniques, such as by wave soldering. After the socket terminals 16 have been soldered to the circuit board, the carrier pins 14 are disengaged from the socket terminals 16 and the carrier board 12 and the carrier pins 14 are removed from the circuit board and either reused or discarded.

Figure 4:
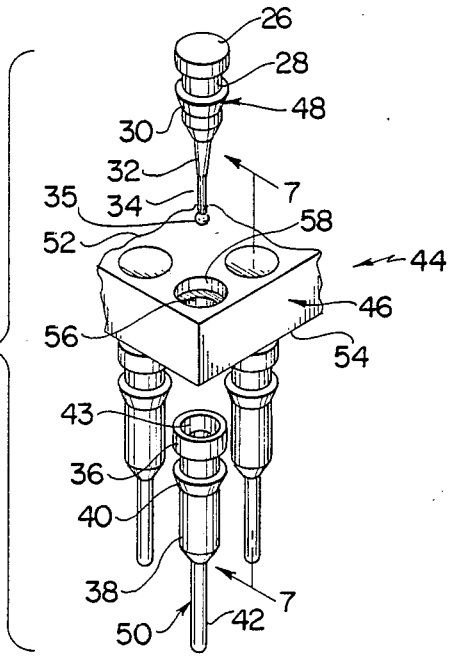
FIG. 4 is a fragmentary perspective view of a second embodiment of the socket terminal carrier assembly.
Figure 7:
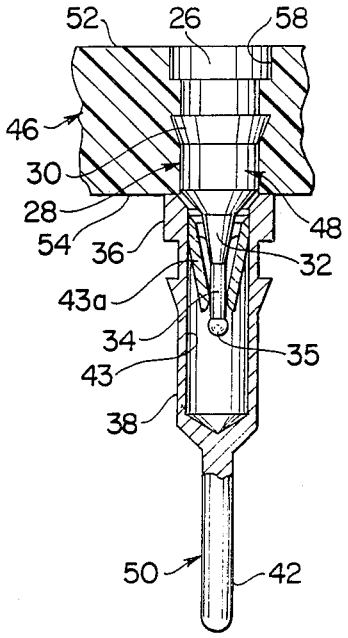
FIG. 7 is a sectional view taken along line 7—7 in FIG. 4.
Figure 6:
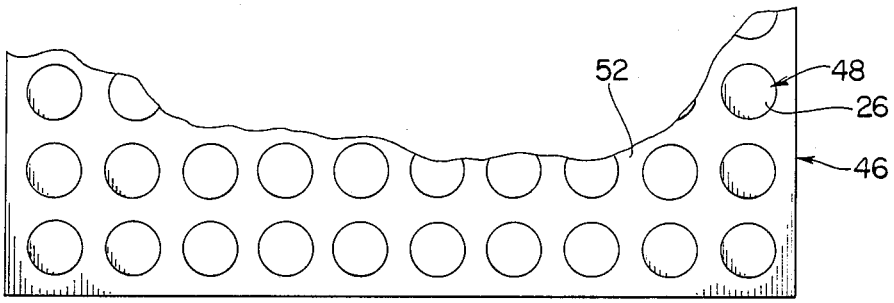
FIG. 6 is a top plan view of the second embodiment of the socket terminal carrier assembly.
Figure 5:
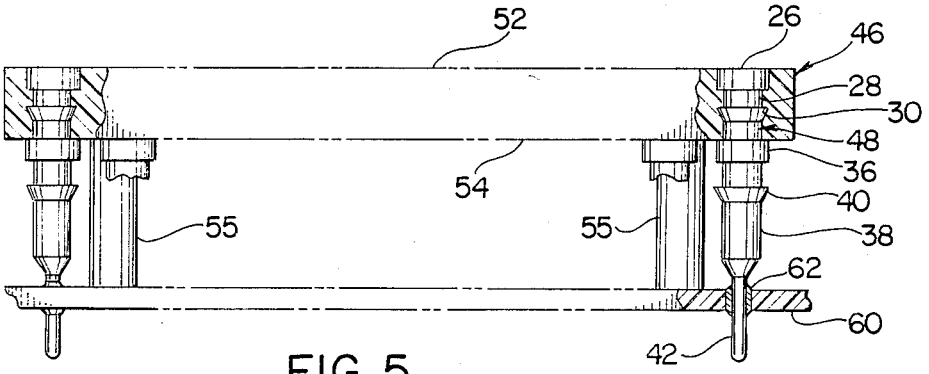
FIG. 5 is a side elevational view thereof partially in section with the socket terminals thereof soldered to a circuit board.

Referring to FIGS. 4 through 6, a second embodiment of the socket terminal carrier assembly of the instant invention is illustrated and generally indicated at 44. The socket terminal carrier assembly 44 comprises a carrier board 46, a plurality of carrier pins generally indicated at 48, and a plurality of socket terminals generally indicated at 50. The carrier board 46 has first and second sides 52 and 54, respectively, a plurality of integrally formed standoff pins 55 which project outwardly from the second side 54 and a plurality of apertures 56 which are disposed in a predetermined array in the carrier board 46, the apertures 56 including enlarged portions 58 which are disposed adjacent to the first side 52. The carrier board 46 preferably comprises a conventional waffer board of the type utilized for pin grid array sockets and it is preferably molded from a suitable plastic material. However, the carrier board 46 is positioned in an inverted disposition relative to the carrier board 12 of the socket terminal carrier assembly 10 so that the enlarged portions 58 are disposed adjacent to the first side 52 of the board 46.

The carrier pins 48 are preferably identical to the carrier pins 14 in the socket terminal carrier assembly 10 and hence they preferably include cap portions 26, reduced main portions 28, annular barb rings 30, intermediate pin portions 32 and terminal pin portions 34 which terminate in substantially spherical terminal end elements 35. However, the carrier pins 48 are assembled with the carrier board 46 so that the cap portions 26 are received in the enlarged portions 58 of the apertures 56 and so that the intermediate and terminal pin portions 32 and 34, respectively, of the carrier pins 48 project outwardly from the second side 54 as illustrated most clearly in FIG. 5.

The socket terminals 50 are preferably identical to the socket terminals 16 in the socket terminal carrier assembly 10 and hence they preferably include enlarged upper socket portions 36, body portions 38, annular barb rings 40, and pin portions 42. The socket terminals 50 have sockets 43 formed therein and they further include angularly, inwardly extending resilient finger **43*a*. The socket terminals 50 are assembled with the carrier pins 48 so that the ends of the internal contact fingers 43 thereof are engageable with the terminal end elements 35 of the carrier pins 48 to releasably retain the socket terminals 50 on the carrier pins 48 and so that the upper socket rings 36 of the socket terminals 50 engage the second side 54 of the carrier board 46**.

Referring now to FIG. 5, the method of assembling a plurality of socket terminals 50 on a circuit board 60 is illustrated. As will be seen, the socket terminal carrier assembly 44 is placed on the circuit board 60 so that the terminal portions 42 of the socket terminals 50 pass through preformed apertures in the circuit board 60. and so that the terminal ends of the standoff pins 55 engage the surface of the board 60. Thereafter, the pin portions 42 are soldered to the board 60 by forming soldered joints 62 which extend through the apertures in the board 60 to permanently connect the socket terminals 50 thereto. Thereafter, the carrier board 46 is moved away from the circuit board 60 so that the carrier pins 48 are disengaged from the socket terminals 50 and the assembly comprising the carrier board 46 and the carrier pins 48 is either discarded or reassembled with a new set of socket terminals 50.

It is seen therefore that the instant invention provides an effective socket terminal carrier assembly for assembling a plurality of socket terminals in a predetermined array on a circuit board. The socket terminal assemblies 10 and 44 include socket terminals 16 and 50, respectively, which are assembled on carrier pins 14 and 48, respectively, and the carrier pins 14 and 48 are rigidly assembled on the carrier boards 12 and 46, respectively, so that the socket terminals 16 and 50 are rigidly held in position while they are assembled with circuit boards. Accordingly, the socket terminals 16 and 50 can be precisely oriented and held in position while they are soldered to circuit boards. Further, when the carrier boards 12 and 46 comprise conventional waffer boards, they are relatively inexpensive and they are readily available in the most common pin array patterns. Accordingly, it is seen that the instant invention represents a significant advancement which has substantial merit in the electrical art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A socket terminal carrier assembly for assembling a plurality of socket terminals in a predetermined array on a circuit board comprising a substantially rigid carrier board having first and second sides and having a plurality of apertures therethrough, said apertures being disposed in said predetermined array and a plurality of carrier pins received and secured in said apertures, said carrier pins having terminal end portions which terminate in enlarged terminal end elements, said carrier pins being positioned on said carrier board so that the terminal end portions thereof project outwardly from the second side of said carrier board, and a plurality of socket terminals snap received in engagement on the terminal end portions of said carrier pins so that they are releasably retained thereon by said terminal end elements and so that said socket terminals are disposed in said predetermined array.

2. The socket terminal carrier assembly of claim 1 further comprising a plurality of standoff pins projecting outwardly by a predetermined distance from the second side of said carrier board and operative for maintaining said carrier board in a predetermined spaced relation to said circuit board during assembly of said socket terminals on said circuit board.

3. In the socket terminal carrier assembly of claim 2, said stand off pins being integrally formed with said carrier board.

4. In the socket terminal carrier assembly of claim 1, said carrier board comprising a rigid plastic waffer board.

5. In the socket terminal carrier assembly of claim 1, said carrier pin terminal end portions being tapered.

6. In the socket terminal carrier assembly of claim 1, said carrier pins being made of metal.

7. In the socket terminal carrier assembly of claim 4, said carrier pins being made of metal.

8. In the socket terminal carrier assembly of claim 5, the terminal end portions of said carrier pins being of substantially circular cross section.

9. In the socket terminal carrier assembly of claim 1, said socket terminal elements each having a socket formed therein and including a plurality of elongated, inwardly extending resilient fingers formed in the interior thereof, said terminal end elements being snap received in the resilient fingers in said socket terminals so that the terminal ends of said fingers are engageable with said terminal end elements to releasably retain said socket elements on said carrier pins.

10. In the socket terminal carrier assembly of claim 9, said terminal elements each having four of said fingers.

11. In the socket terminal carrier assembly of claim 1, said terminal elements being substantially spherical.

* * * * *